US010253541B2

(12) United States Patent
Pecar et al.

(10) Patent No.: US 10,253,541 B2
(45) Date of Patent: Apr. 9, 2019

(54) HINGE ASSEMBLY

(71) Applicant: Titus D.O.O. Dekani, Dekani (SI)

(72) Inventors: David Pecar, Pobegi (SI); Valter Svara, Izola (SI)

(73) Assignee: Titus d.o.o. Dekani, Dekani (SI)

( * ) Notice: Subject to any disclaimer, the term of this patent is extended or adjusted under 35 U.S.C. 154(b) by 0 days.

(21) Appl. No.: 15/034,212

(22) PCT Filed: Nov. 5, 2014

(86) PCT No.: PCT/EP2014/073827
§ 371 (c)(1),
(2) Date: May 4, 2016

(87) PCT Pub. No.: WO2015/067663
PCT Pub. Date: May 14, 2015

(65) Prior Publication Data

US 2016/0273258 A1 Sep. 22, 2016

(30) Foreign Application Priority Data

Nov. 5, 2013 (GB) ..... 1319534

(51) Int. Cl.
*E05F 1/08* (2006.01)
*E05F 5/00* (2017.01)
(Continued)

(52) U.S. Cl.
CPC ..... *E05F 5/006* (2013.01); *E05F 5/02* (2013.01); *E05F 5/10* (2013.01); *E05Y 2201/256* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 7,748,082 B2 7/2010 Harald et al.
2004/0201154 A1 10/2004 Salice
(Continued)

FOREIGN PATENT DOCUMENTS

CA 2273680 A1 2/2000
EP 2589736 A1 * 5/2013 ..... E05F 5/006
(Continued)

*Primary Examiner* — Chuck Y Mah
(74) *Attorney, Agent, or Firm* — Alan D. Kamrath; Kamrath IP Lawfirm, P.A.

(57) ABSTRACT

A hinge assembly in the form of a toggle type hinge includes an arm assembly (11) anchorable in use to a first member and a cup flange (13) pivotally connected thereto and anchorable in use to a second member. The assembly includes a linear damping device (15) and a mechanism for converting pivotal movement of the hinge into actuation of the damping device, at least over part of the range of this pivotal movement. The movement converting mechanism is arranged to produce the actuation of the damping device (15) through rotational movement about its linear axis via transmission of at least two equal and opposite forces acting symmetrically about this axis.

12 Claims, 2 Drawing Sheets

(51) Int. Cl.
*E05F 5/02* (2006.01)
*E05F 5/10* (2006.01)

(52) U.S. Cl.
CPC ... *E05Y 2201/264* (2013.01); *E05Y 2201/266* (2013.01); *E05Y 2201/638* (2013.01); *E05Y 2900/20* (2013.01)

(58) Field of Classification Search
CPC ..... E05Y 2201/21; E05Y 2201/256; E05Y 2201/264; E05Y 2201/266; E05Y 2201/638; E05F 5/006; E05F 5/02; E05F 5/10; E05D 11/1021; E05D 11/1042; E05D 11/105; E05D 11/1064; E05D 2201/20; E05D 11/21; E05D 11/256; E05D 11/264; E05D 11/266; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 2008/0209674 | A1* | 9/2008 | Harald | E05F 5/006 16/82 |
| 2009/0119875 | A1 | 5/2009 | Migli | |
| 2009/0119876 | A1 | 5/2009 | Pecar et al. | |
| 2010/0139041 | A1* | 6/2010 | Pecar | E05F 5/006 16/273 |
| 2012/0036678 | A1* | 2/2012 | Pecar | E05F 5/006 16/250 |
| 2013/0283568 | A1 | 10/2013 | Vallance et al. | |
| 2015/0292252 | A1* | 10/2015 | Svara | E05F 5/006 16/341 |

FOREIGN PATENT DOCUMENTS

| | | | | |
|---|---|---|---|---|
| GB | 2469847 A | | 3/2010 | |
| GB | 2511480 A | * | 9/2014 | E05F 5/006 |

* cited by examiner

HINGE ASSEMBLY

BACKGROUND

This invention relates to hinge and damper assemblies and, more particularly, to hinge assemblies comprising toggle type hinges of the sort that are typically used on kitchen cupboards, together with a damping device.

Arrangements are known for mounting a linear acting damping device on a toggle type hinge in which a mechanism is incorporated for converting rotational movement from the hinge into linear actuation of the damping device. Operation of these movement converting mechanisms gives rise to frictional forces, and these affect the resultant damping resistance that the assembly produces. A problem is how to minimise the frictional force effect in these assemblies in order to have control over their damping characteristics.

The present invention provides a hinge assembly comprising a toggle type hinge with an arm assembly anchorable in use to a first member and a cup flange pivotally connected thereto and anchorable in use to a second member, a linear damping device, and a mechanism for converting pivotal movement of the hinge into actuation of the damping device at least over part of the range of said pivotal movement, with the movement converting mechanism arranged to produce said actuation of the damping device from rotational movement about its linear axis via transmission of at least two equal and opposite forces acting symmetrically about said axis.

BRIEF DESCRIPTION OF THE DRAWINGS

By way of example, embodiments of the invention will now be described with reference to the accompanying drawings, in which.

DETAILED DESCRIPTION

Figure 1:
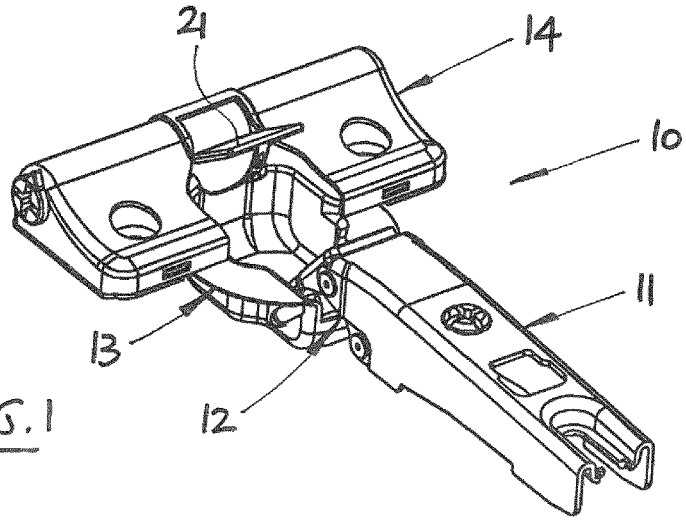
FIG. 1 illustrates a toggle type hinge incorporating a form of damper assembly according to the invention.

In FIG. 1, a conventional form of toggle type hinge 10 for mounting a door panel is seen with an arm assembly 11 that is anchorable in known manner to a first member, typically the carcase of a cupboard. Articulatedly connected to the arm assembly 11 by a compound linkage 12 is a hinge cup flange 13, which is mountable in known manner to a second member, usually the door panel. A damper assembly 14 is mountable on or incorporated as part of the hinge 10 in order to provide a damped resistive force to the closing movement of the door.

Figure 2:
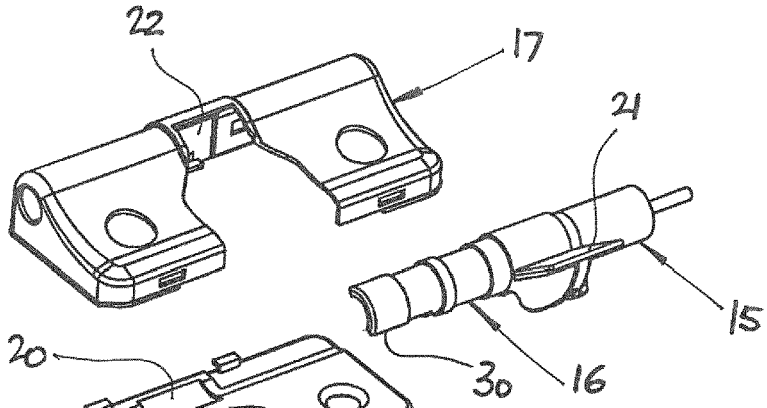
FIG. 2 is an exploded view of the hinge and damper assembly of FIG. 1.
Figure 3:
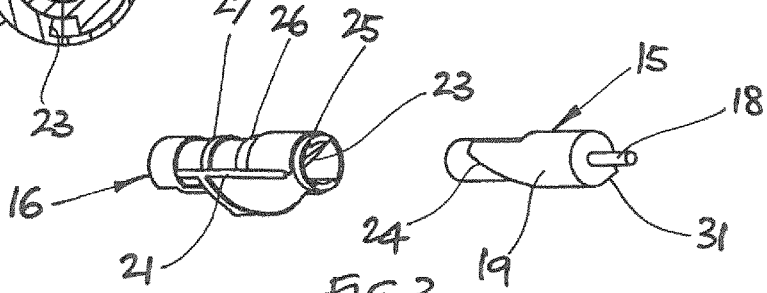
FIG. 3 is a detail showing the actuator and damping device of the damper assembly in FIGS. 1 and 2.

The damper assembly 14 and its component parts are seen more clearly in FIGS. 2 and 3. It compromises a damping device 15, an actuator 16 and a housing 17. The damping device 15 is of a linear position and cylinder variety with a piston (not shown) arranged on a piston rod 18 for reciprocal movement in a damping medium such as silicone contained within a cylinder 19, with a spring (not shown) normally biasing the piston towards an extended position of the piston rod out of the cylinder. Compression of the device 15 by movement of the piston rod 18 into the cylinder 19 produces a damped resistive force. Extension of the device 15 by movement of the position rod 18 out of the cylinder 19 occurs under the biasing action of the spring and without damping.

The damping device 15 is mounted within the actuator 16. The actuator 16 is of a generally elongate cylindrical shape and is designed to receive the damping device 15 within its interior, with their longitudinal axes co-aligned. The actuator 16 is designed to be mounted on the hinge cup flange 13 and to be retained in position there by the housing 17. The hinge cup flange 13 has a radiused groove 20 in its surface for the purpose of mounting the actuator 16 such that it is able to rotate about its longitudinal axis. The housing 17 is also shaped to retain and guide the actuator 16 for this rotational movement. The actuator 16 is prevented from movement in its axial direction.

The actuator 16 has a radially outwardly extending wing 21. The housing 17 is provided with an opening 22 through which the wing 21 is able to protrude. In use, as will be understood from FIG. 1, the wing 21 is positioned so as to come into contact with the arm assembly 11 of the hinge 10 during the closing movement of the door panel that it mounts. The engagement of the arm assembly 11 with the wing 21 in this manner causes the actuator 16 to rotate about its longitudinal axis. This rotational movement of the actuator 16 is converted into linear compression of the damping device 15. Compression of the damping device 15 produces a damped resistive force, which is transmitted back to the door to attenuate its closing movement.

A mechanism is provided for converting the rotational movement of the actuator 16 into linear compression of the damping device 15. This takes the form of a cam profile 23 on the inside of the actuator 16 and a corresponding cam profile 24 on the outer surface of the cylinder 19.

The cylinder 19 is designed to be able to move axially with respect to the actuator 16, but to be prevented from rotating about its longitudinal axis, here by a flat 31 on its outer surface which engages the surface of the hinge cup flange 13. The arrangement means that when the actuator 16 rotates about its longitudinal axis, the cylinder 19 will be caused to move axially out of the actuator, by the action of the interengaging cam profiles 23, 24. With the end of the piston rod 18 abutting against the inside of the housing 17, this movement of the cylinder 19 means that the damping device 15 is effectively compressed, thus producing a damped resistive force.

Figure 4:
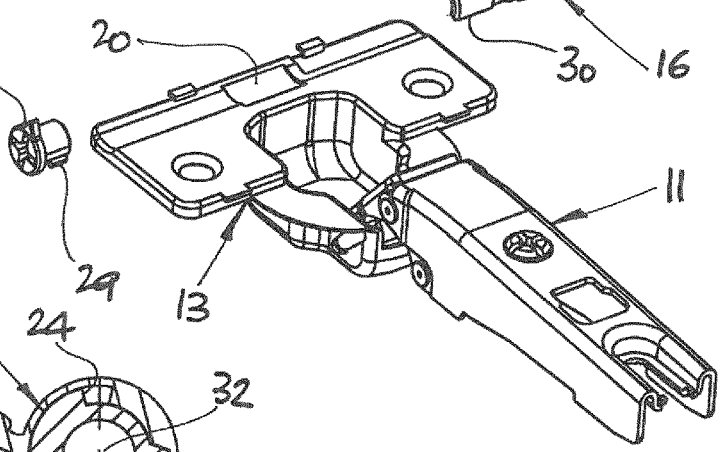
FIG. 4 is a sectional view through the actuator and damping device of FIG. 2.
Figure 4:
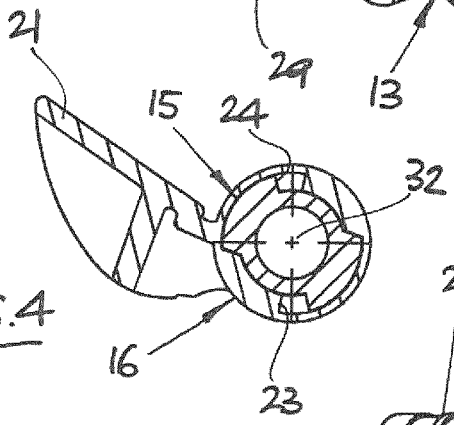

The cam profiles 23, 24 on the cylinder 19 and actuator 16 each consist of a pair of helically extending camming surfaces. The camming surfaces in each case are provided as diametrically opposed pairs, as seen in FIG. 4. This means that the forces acting in the movement converting mechanism are transmitted in the form of a couple, i.e. symmetrically about the rotational axis 32 of the actuator and damping device. This helps to prevent the damping device 15 from going out of alignment with the actuator 16 and thus helps to reduce the frictional forces generated by operation of the mechanism.

It is to be noted that instead of providing complementarily engaging cam profiles on both of the cylinder and actuator, it would be possible to provide just one cam profile on either one of these components, with a cam follower being provided on the other. The effect would still be to cause conversion of rotational motion into linear motion. Preferably, the cam profile would again take the form of an opposing pair of camming surfaces in order to balance the transmission of forces, and the cam follower could take the form of a pair of opposing pins or the like. An advantage of this arrangement is that it does not require the cam profile to have a uniform pitch.

To further reduce frictional forces, the actuator 16 is provided with circumferentially extending outer bearing surfaces 25, 26, 27. These are spaced apart along the body of the actuator 16 and it is by these bearing surfaces 25, 26, 27 that the actuator engages the radiused groove 20 on the hinge cup flange 13 and the housing 17. It will be noted that two of the bearing surfaces 25, 26, are located to either side of the wing 21. This helps to balance the load on the actuator 16 from the action of the arm assembly 11 engaging the wing 21, helping to avoid the actuator becoming misaligned in its rotational movement.

The use of bearing surfaces enables the amount of sliding surface contact between the actuator 16 and hinge cup flange 13 to be controlled and hence for frictional forces to be minimised. It will be understood that the particular configuration of the bearing surfaces in terms of their number, location and form can be varied from the particular arrangement shown here, as can the materials used. In particular, it is not essential for the bearing surfaces to extend fully circumferentially: one or more of them could be arranged to extend only part way round the circumference of the actuator body.

The damper assembly 14 here is designed to be adjustable. A knob 28 is mounted on the housing 17 so as to be engagable with the actuator 16. A flat 30 on the end of the actuator 16 is designed to abut against a lug 29 on the knob 28. Rotation of the knob 28 moves the rotational position of the lug 29 and hence the orientation of the actuator 16 at rest. Thus the point in the closing movement of the door at which the arm assembly 11 comes into contact with the wing 21 can be adjusted.

Figure 5:
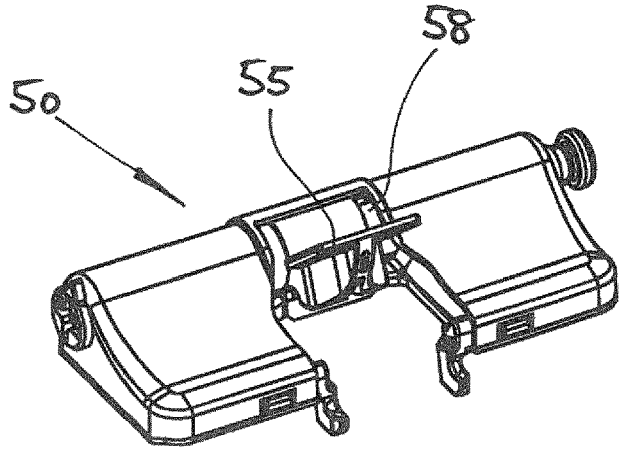
FIG. 5 illustrates an alternative form of damper assembly according to the invention.
Figure 7:
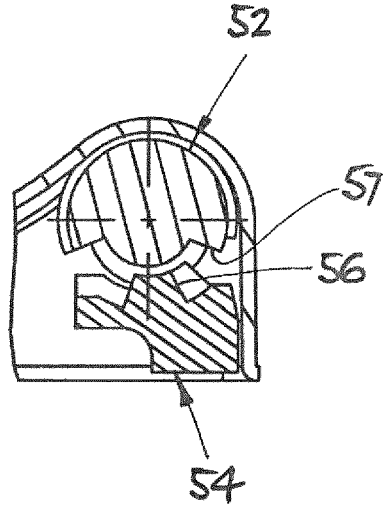
FIG. 7 is a sectional view through the second movement converting mechanism of FIG. 6.
Figure 6:
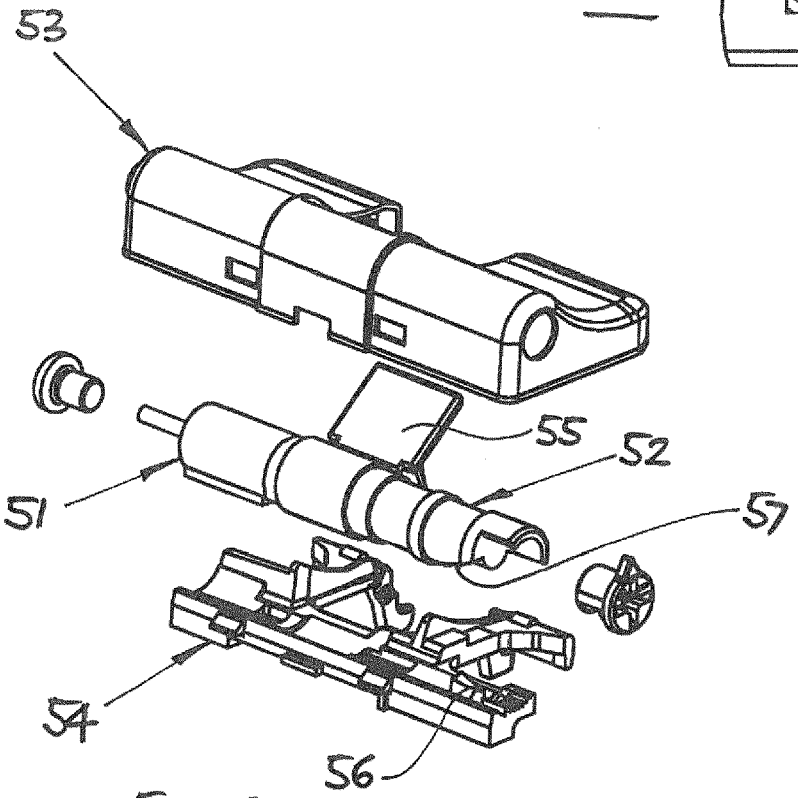
FIG. 6 is an exploded view of the damper assembly of FIG. 5.

The damper assembly 50 seen in FIGS. 5 and 6 is similar to that described above in that it comprises a damping device 51, an actuator 52 and a housing 53. In this case, the actuator 52 is designed to be mounted not directly onto a hinge cup flange, but via a baseplate 54. Otherwise, the actuator 52 is much like the actuator described above in that it is rotatable about its longitudinal axis and has a wing 55 protruding through an opening 58 in the housing 50 to engage the arm assembly of a hinge.

The damping device 51 is likewise similar to that described above and in particular, is operatively engaged with the actuator 52 by the same form of movement converting mechanism whereby rotational movement of the actuator causes axial displacement (and hence compression) of the damping device, with the forces being transmitted by a couple. The difference in this case is that a second mechanism is incorporated for providing an additional compressive action on the damping device 51.

The second mechanism here takes the form of a lug 56 on the baseplate 54 and a cam profile 57 on the actuator 52. The cam profile 57 presents a helically extending camming surface. When the actuator 52 is caused to rotate, by the action of the hinge arm assembly on the wing 55, the cam profile 57 will come into contact with the lug 56. Because the cam profile 57 is in the nature of a camming surface, further rotation of the actuator 52 will cause its axial displacement. It will be noted that the opening 58 in the housing 53 in this assembly is greater than the width of the wing 55, to allow for the axial displacement of the actuator 52.

The lug 56 shown here is also shaped with a cam profile, which is complementary to the cam profile 57 on the actuator 52. It will be understood, however, that the lug 56 could instead be in the form of a plain follower, such as a pin with a rounded head.

The axial displacement of the actuator 52 is arranged here to be in the same sense as the displacement caused by operation of the first movement converting mechanism, i.e. the two displacements are supplementary. The effect is to cause an increase in the amount, and hence the speed, of compression of the damping device 51, which thereby increases the damped resistive force that it generates.

The provision of two modes of compression of the damping device 51 in this arrangement makes it readily able to be tailored to give different damping characteristics. For example, the particular point in the rotational movement of the actuator 52 that the cam profile 57 comes into engagement with the lug 56 can be varied. This will affect the point at which the enhanced damping resistance will be applied to the closing door. Also, the pitch of the cam profile 57 can be chosen to be different from that of the actuator/cylinder cam profile, so as to provide a different rate of linear compression of the damping device per degree of rotation of the actuator. Of course it would be possible to arrange for the second mechanism to operate in the opposite sense to the first mechanism, rather than in the same sense, which would have the effect of reducing the damping resistance provided by the assembly during the course of the closing movement of the door.

The invention claimed is:

1. A hinge assembly comprising:

a toggle type hinge with an arm assembly anchorable in use to a first member and a hinge cup flange pivotally connected thereto about a hinge axis and anchorable in use to a second member;

an actuator mounted on the hinge cup flange or on a part connected with the hinge cup flange;

a linear damping device mounted within the actuator and actuable in a linear axis parallel to but offset from the hinge axis, with the actuator mounted for rotation about an axis that is coincident with the linear axis of the linear damping device;

a first caroming surface on the linear damping device; and a second camming surface on the actuator and engaging the first camming surface, with the first camming surface and the second camming surface each being arranged to extend symmetrically on diametrically opposite sides of the linear axis of the linear damping device and causing relative linear movement between the actuator and the linear damping device upon relative rotational movement between the actuator and the linear damping device, with the actuator arranged to be engaged by the arm assembly of the toggle type hinge at an engagement point, and with pivotal movement of the toggle type hinge causing relative rotational movement between the actuator and the linear damping device at least over part of a range of said pivotal movement of the toggle type hinge to produce linear compression of the linear damping device via transmission of equal and opposite forces acting symmetrically about the linear axis through the first camming surface and the second camming surfaces.

2. A hinge assembly as claimed in claim 1 wherein the first and second camming surfaces extend helically with respect to the linear axis of the linear damping device.

3. A hinge assembly as claimed in claim 1 wherein the actuator is mounted via bearing surfaces on the hinge cup flange or on a part connected with the hinge cup flange.

4. A hinge assembly as claimed in claim 1 further comprising bearing surfaces located on either side of said engagement point.

5. A hinge assembly as claimed in claim 4 wherein the bearing surfaces are in the form of annular rings extending wholly or partly around a circumference of the actuator.

6. A hinge assembly as claimed in claim 1, further comprising a movement converting mechanism for further converting the pivotal movement of the toggle type hinge into the linear compression of the linear damping device, including a lug mounted on the hinge cup flange or on a part connected with the hinge cup flange and a third camming surface on the actuator, wherein the third camming surface contacts the lug when the pivotal movement of the toggle type hinge causes the actuator to rotate.

7. A hinge assembly as claimed in claim 6 wherein the movement converting mechanism operates in a same range of pivotal movement as the first and second camming surfaces.

8. A hinge assembly as claimed in claim 6 wherein the movement converting mechanism operates at a different range of the pivotal movement of the toggle type hinge from the first and second camming surfaces.

9. A hinge assembly as claimed in claim 6 wherein the movement converting mechanism operates at a different rate of the linear compression per degree of rotation from the first and second camming surfaces.

10. A hinge assembly as claimed in claim 6 wherein the third camming surface extends helically with respect to the linear axis of the linear damping device.

11. A hinge assembly comprising:

a toggle type hinge with an arm assembly anchorable in use to a first member and a hinge cup flange pivotally connected thereto about a hinge axis and anchorable in use to a second member;

an actuator mounted on the hinge cup flange or on a part connected with the hinge cup flange;

a linear damping device mounted within the actuator and actuable in a linear axis parallel to but offset from the hinge axis, with the actuator mounted for rotation about an axis that is coincident with the linear axis of the linear damping device; and a cam profile provided on the linear damping device or on the actuator and a cam follower provided on the other of the linear damping device or on the actuator, with the cam profile and the cam follower arranged to extend symmetrically on diametrically opposite sides of the linear axis and causing relative linear movement between the actuator and the linear damping device upon relative rotational movement between the actuator and the linear damping device, with the actuator arranged to be engaged by the arm assembly of the toggle type hinge at an engagement point, and with pivotal movement of the toggle type hinge causing relative rotational movement between the actuator and the linear damping device at least over part of a range of said pivotal movement of the toggle type hinge to produce linear compression of the linear damping device via transmission of equal and opposite forces acting symmetrically about the linear axis through the cam profile and the cam follower.

12. A hinge assembly as claimed in claim 11 wherein the cam profile comprises an opposing pair of camming surfaces, and the cam follower comprises a pair of opposing pins.

* * * * *